US012076607B2

(12) United States Patent
Shishtar

(10) Patent No.: US 12,076,607 B2
(45) Date of Patent: Sep. 3, 2024

(54) PEG SYSTEM OF A TABLE TOP FOR ARMWRESTLING

(71) Applicant: Hadi Shishtar, Kansas City, KS (US)

(72) Inventor: Hadi Shishtar, Kansas City, KS (US)

( * ) Notice: Subject to any disclaimer, the term of this patent is extended or adjusted under 35 U.S.C. 154(b) by 0 days.

(21) Appl. No.: 18/623,303

(22) Filed: Apr. 1, 2024

(65) Prior Publication Data

US 2024/0245949 A1 Jul. 25, 2024

(51) Int. Cl.
*A63B 21/28* (2006.01)
*A63B 23/12* (2006.01)

(52) U.S. Cl.
CPC ..... *A63B 21/28* (2013.01); *A63B 23/129* (2013.01)

(58) Field of Classification Search
CPC ..... A47B 3/06; A47B 13/02; A63B 23/129; A63B 21/28
See application file for complete search history.

(56) References Cited

U.S. PATENT DOCUMENTS 4,068,843 A * 1/1978 Frost ..... A63B 23/129 482/905
4,135,691 A * 1/1979 Wiesmann ..... A47B 3/0809 248/439
4,138,953 A * 2/1979 Tashman ..... A47B 57/265 248/188
4,162,068 A * 7/1979 Berg ..... A63B 21/28 273/455
4,754,964 A * 7/1988 Michaels ..... A63B 23/129 482/130
5,613,927 A * 3/1997 Rothacker ..... A63B 21/28 482/44
2015/0173506 A1* 6/2015 Carter ..... A47B 19/00 248/445
2021/0016130 A1* 1/2021 Cope ..... A63B 21/4029
2021/0275871 A1* 9/2021 Rothacker ..... A63B 21/4043
2024/0041200 A1* 2/2024 Wangberg ..... A47B 91/005

OTHER PUBLICATIONS

Mazurenko, Armwrestling shop tables, published: Mar. 5, 2024, <URL: https://web.archive.org/web/20240305042952/ https://armwrestlingshop.com/en/category/11/table> (henceforth Mazurenko) (Year: 2024).*

* cited by examiner

*Primary Examiner* — Zachary T Moore
(74) *Attorney, Agent, or Firm* — Alexander Postnikov

(57) ABSTRACT

A two part peg system including a handle used by armwrestlers to hold while armwrestling (the peg has a male thread), and a second part which is a peg base having a head that rests on the surface of the table and also a vertical body. The body passes through the leather, foam, wooden top and steel frame. The male portion (thread) of the peg base is responsible of holding leather, foam, wooden top and steel frame only when fastened or locked (the strength and rigidity is attained only when fastened or locked). The female thread of peg base passes through the head as well as the body of the peg base and creates a space to receive the male portion of the peg. The peg base holds the table wooden top including its leather and foam with steel frame together, and allows the peg to sit in it.

15 Claims, 8 Drawing Sheets

(PRIOR-ART)

PEG SYSTEM OF A TABLE TOP FOR ARMWRESTLING

TECHNICAL FIELD

The disclosure relates to the technical field of sports and entertainment. More specifically, the disclosure relates to an improved peg system of a table top for armwrestling.

BACKGROUND

Arm wrestling (also spelled as armwrestling and also interchangeably hereinafter referred to as "armwrestling" or "arm-wrestling") is a sport with two opponents who face each other with their bent elbows placed on a table and hands firmly gripped, who then attempt to force the opponent's hand down to the table top ("pin" them). The sport is often casually used to demonstrate the stronger person between two or more people.

Tables used for organized armwrestling competitions include elbow pads, which indicate the area within which a competitor's elbow must remain throughout the match, pin pads, which indicate the height an opponent's hand must reach before being considered pinned, and hand pegs, which must be gripped with the non-wrestling hand and are used for additional leverage. These tables vary slightly in their dimensions based on the governing body of the competition, but are always symmetrical with predefined distances between the elbow pads and pin pads.

Normally, the conventional and worldwide accepted armwrestling table, as shown in FIG. 1 can have many parts, including:

Table top (102): A board covered with a soft rubber and abrasion resistant artificial leather. The table top should be 36 inches long and 26 inches wide. For sit-down competition, the tabletop should be 28 inches from the floor. For stand-up matches, the table top should be 40 inches from the floor. The peg should be 2.5 cm (1 inch) in diameter and 15.2 cm (6 inches) high from the tabletop.

Side pads (104): Two side pads, Elbow pads (106): Two elbow pads, Peg systems (108): Steel handles plated with nickel, Frame: Made of steel, Legs (110): Four legs with a minimum of 28 inches inside leg and a minimum of 18 inches leg to leg, other parts: Chalk stand, staging, riser platforms, and straps.

Peg systems (108) are positioned at the central side edges of the table. Hand pegs provide a stable hold for the non-wrestling hand of the competitors. They (pegs) can vary in design, but they are typically ergonomic and allow the wrestler to exert force while maintaining balance and stability.

The hand peg on an arm-wrestling table serves several important purposes, contributing significantly to the dynamics and fairness of the match. Following reasons as to why the hand peg is important:

Stability and Control: The hand peg provides a stable point of contact for the non-wrestling hand of each competitor. By gripping pegs firmly, wrestlers can exert force and maintain control over their body position during the match. This stability is crucial for maintaining balance and applying maximum force against the opponent's hand and arm.

Leverage: The positioning of the hand peg relative to the elbow pad allows wrestlers to leverage their body weight and strength more effectively. By anchoring their non-wrestling hand on the peg, wrestlers can generate torque and transfer power from their upper body to their arm, enhancing their ability to push or pull against the opponent.

Counterbalance: During an arm-wrestling match, competitors exert considerable force, which can lead to shifts in body weight and balance. The hand peg serves as a counterbalance, helping wrestlers to stabilize their upper body and prevent tipping or falling off the table. This is especially important in intense matches where both competitors are pushing their limits.

Preventing Fouls: In official arm-wrestling competitions, there are rules governing hand placement and movement. The hand peg provides a designated area for the non-wrestling hand, helping to prevent fouls such as lifting or sliding the hand off the table during the match. By maintaining contact with the hand peg, wrestlers can ensure that they adhere to these rules and avoid penalties.

Fairness: Ensuring that both competitors have access to a stable hand peg promotes fairness in the match. By providing a standardized point of contact for the non-wrestling hand, the hand peg helps to create a level playing field where wrestlers can focus on using their strength and technique to overcome their opponent, rather than being hindered by differences in table setup or equipment.

Overall, the hand peg plays a critical role in arm wrestling, providing stability, leverage, and fairness to competitors as they vie for victory on the arm-wrestling table.

SUMMARY

The disclosure relates to the technical field of sports and entertainment. More specifically, the disclosure relates to an improved hand peg of a table top for armwrestling.

In contrast, the present disclosure provides an improved hand peg of a table top for armwrestling.

In the present invention, the peg system is divided into two parts. The first part is the peg that is there for the arm wrestler to hold while armwrestling with his/her other arm. The peg has a male thread. The second part is the peg base which has a head that rests on the surface of the table and has a vertical body. The body has either full or a partial outer male thread that passes through the leather, foam, wooden top and steel frame. The male portion (thread) is responsible of holding leather, foam, wooden top and steel frame only when fastened or locked (the strength and rigidity is attained only when fastened or locked). The female thread passes through the head as well as the body of the peg base and creates a space to receive the male portion of the peg.

In contrast to the convention pegs used in/on a table top for armwrestling table, the peg system, specifically the peg base, allows the peg to sit on it. It also holds the table wooden top including its leather and foam as well as the steel frame together. The peg base provides strength and rigidity to the table top when the at least one fastener is fastened to thereby stabilize the arm wrestling table when the at least one competitor exerts force on the peg.

An aspect of the present disclosure provides an armwrestling table having a table top. The armwrestling table includes the table top having at least a first layer and a second layer. The armwrestling table includes a peg system to provide a hold for a non-wrestling hand of at least one competitor. The peg operates as the handle and has a male threaded part to it The peg system further includes a peg base having a bore provided with one or more inner threads adapted to receive the threaded part of the peg thus, holding the peg at least perpendicular to the table top. The peg base also has a flat head and an elongated body.

The elongated body of the peg base comprises a plurality of outer threads to accommodate at least one fastener thereon such that the flat head rests on a top surface of the table top and the elongated body passes through the first layer and the second layer so as to rigidly hold the first layer and the second layer of the table top intact to provide strength and rigidity to the table top when the at least one fastener is fastened to thereby stabilize the armwrestling table when the at least one competitor exerts force on the hand peg while maintaining balance and stability.

In another aspect, an armwrestling table is disclosed. The armwrestling table includes a table top, and a hand peg to provide a hold for a non-wrestling hand of at least one competitor.

The peg system includes a peg having a threaded part, and a peg base having a flat head, an elongated body, and a bore provided with one or more inner threads passing length wise through the flat head to the elongated body. The bore is adapted to receive the threaded part of the peg to hold the hand peg at least perpendicular to the table top.

The elongated body of the peg base comprises a plurality of outer threads to accommodate at least one fastener thereon, such that the flat head rests on a top surface of the table top and the elongated body passes through the first layer and the second layer.

Other objects and advantages of the invention will become readily apparent from the following description of the invention.

BRIEF DESCRIPTION OF DRAWINGS

The accompanying drawings are included to provide a further understanding of the present disclosure and are incorporated in and constitute a part of this specification. The drawings illustrate exemplary embodiments of the present disclosure and, together with the description, serve to explain the principles of the present disclosure.

The diagrams are for illustration only, which thus is not a limitation of the present disclosure, and wherein.

DETAILED DESCRIPTION OF DRAWINGS

Figure 1:
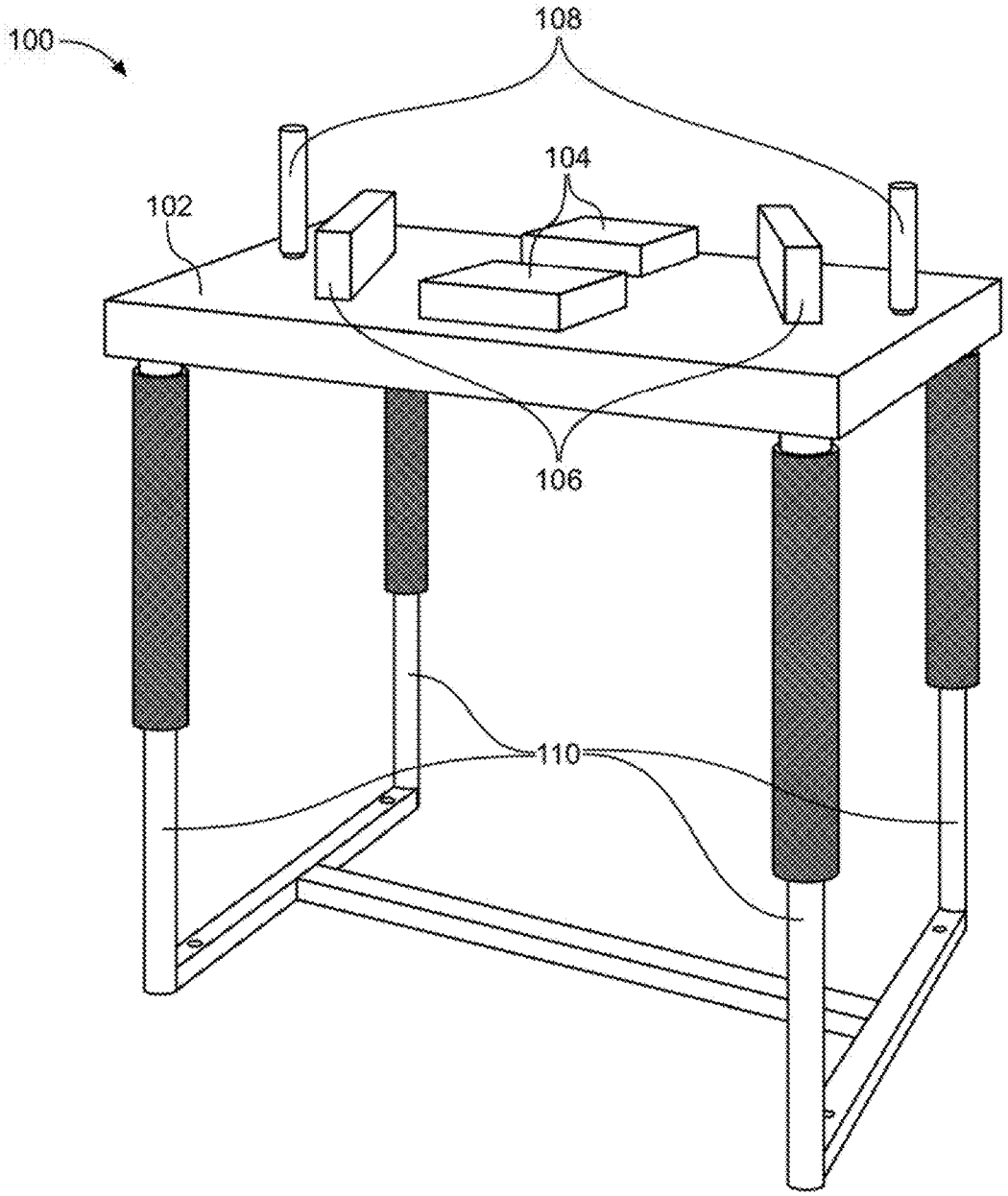
FIG. 1 illustrates an exemplary conventional and worldwide accepted armwrestling table, available in the prior-art.
Figure 2A:
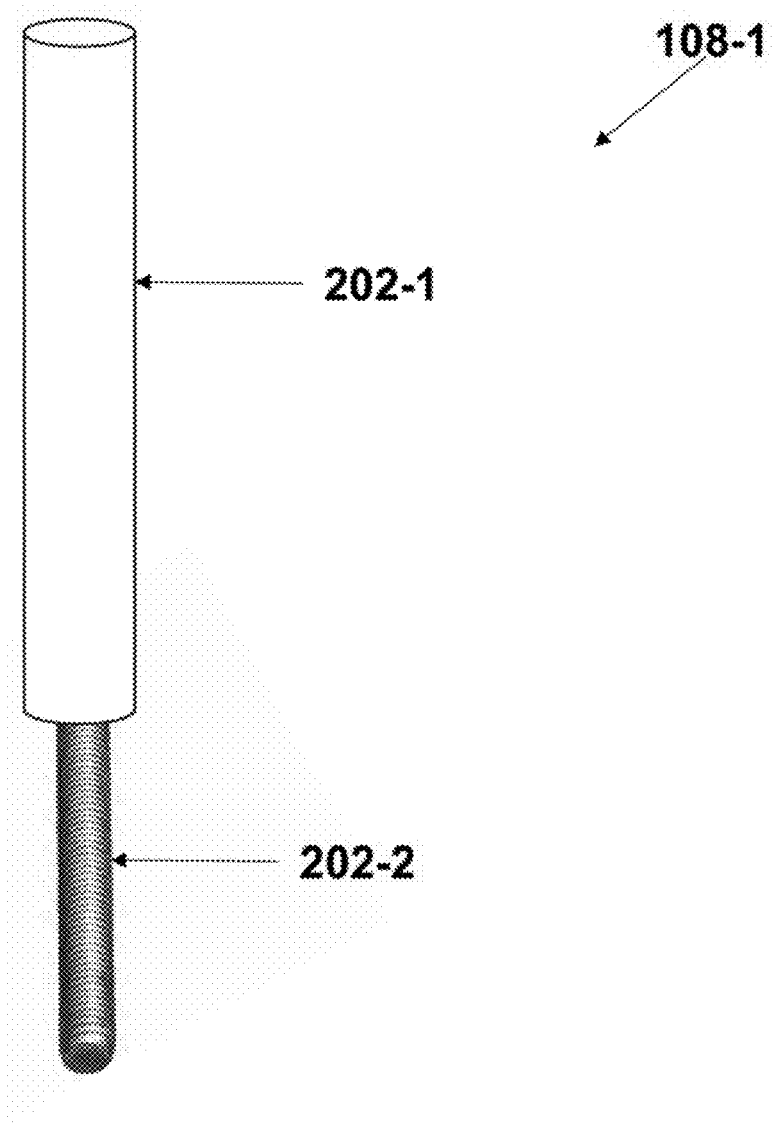
FIGS. 2A-2E illustrates a peg system and its components, in accordance with an embodiment of the present invention.
Figure 2B:
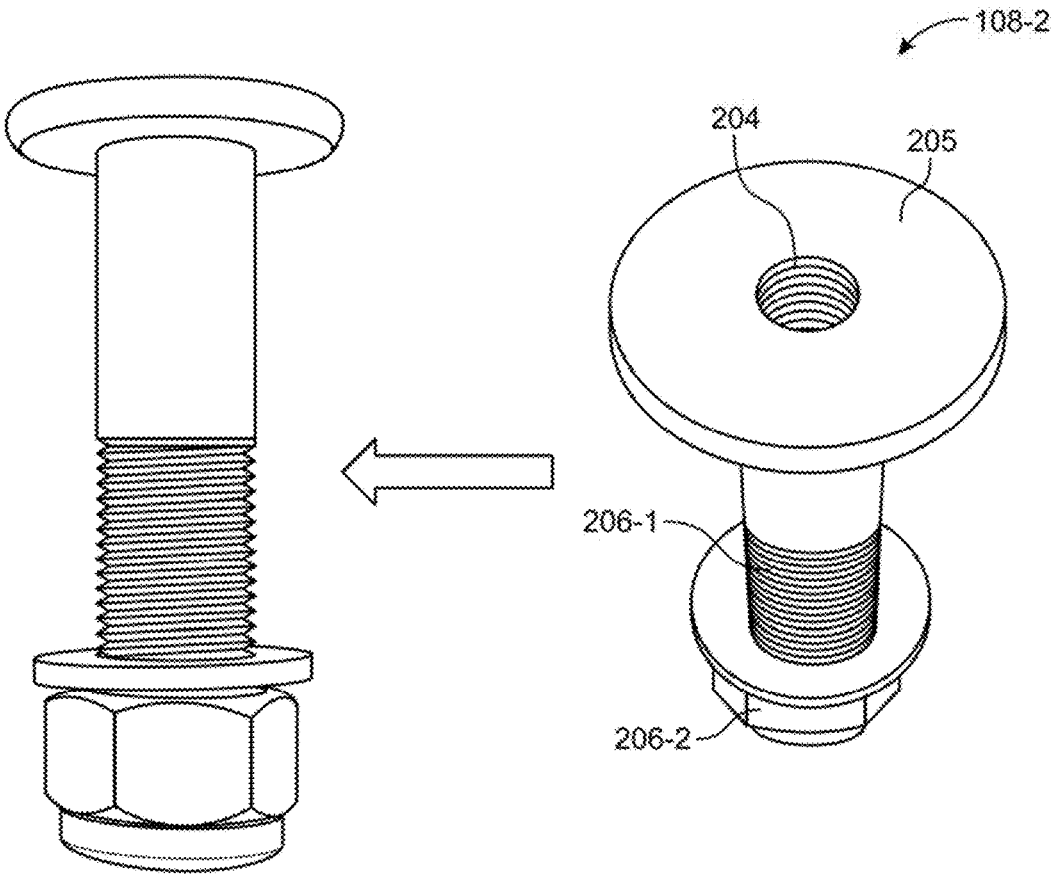
Figure 2C:
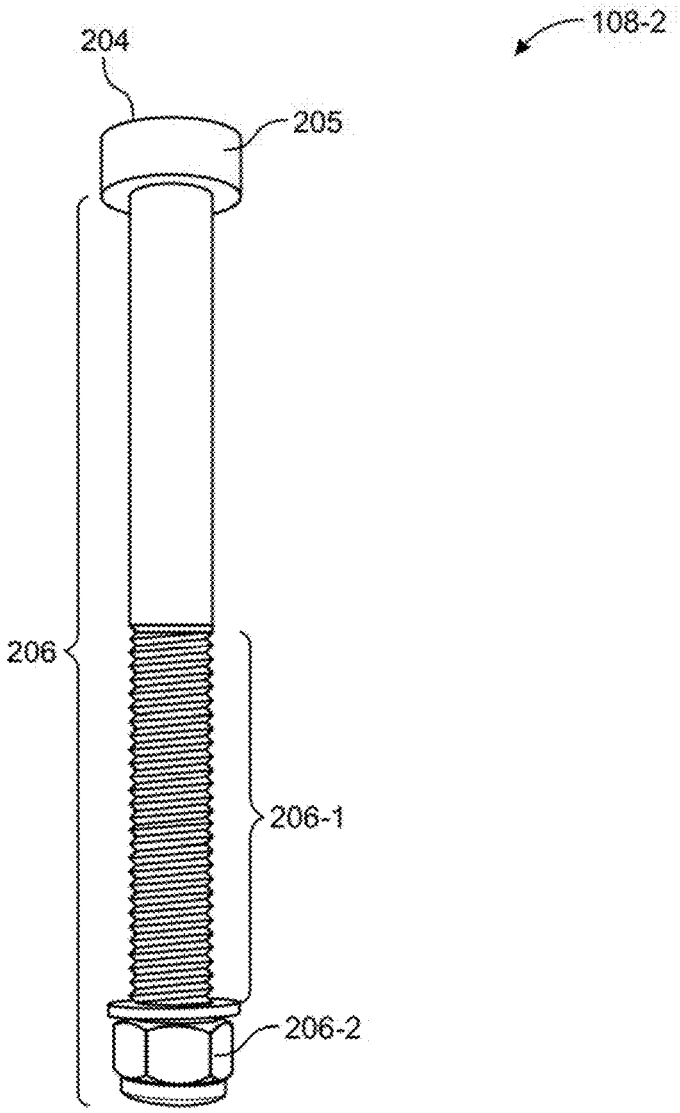
Figure 2D:
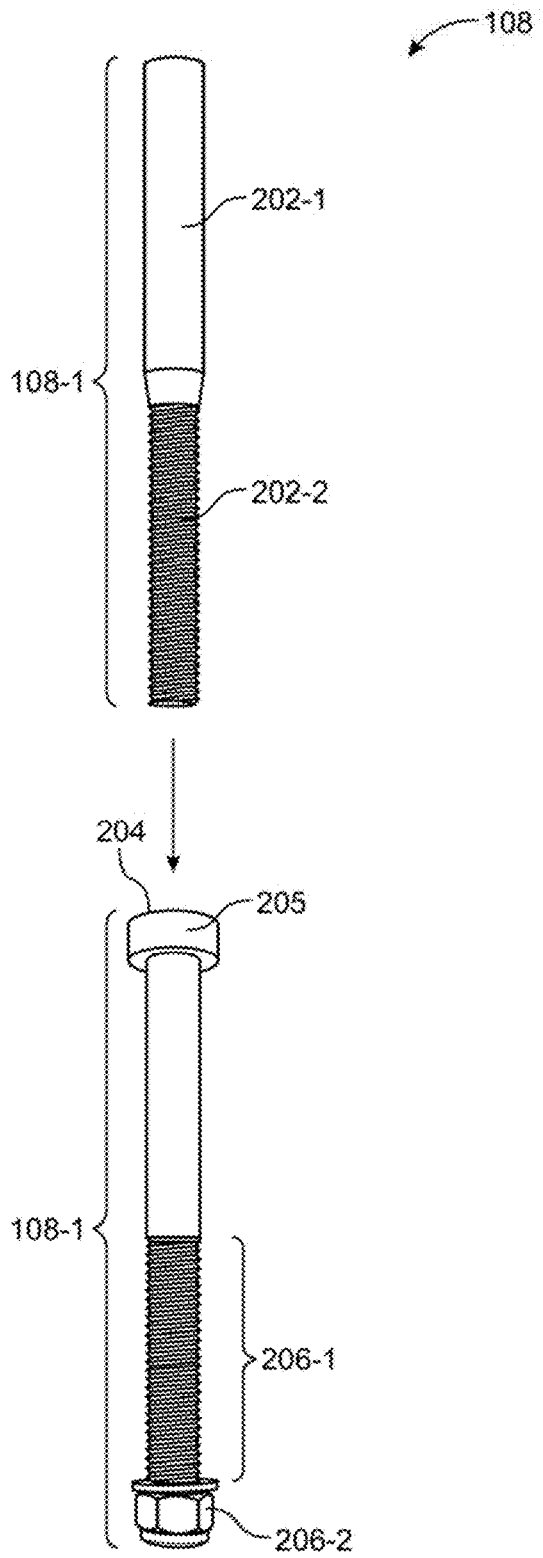
Figure 2E:
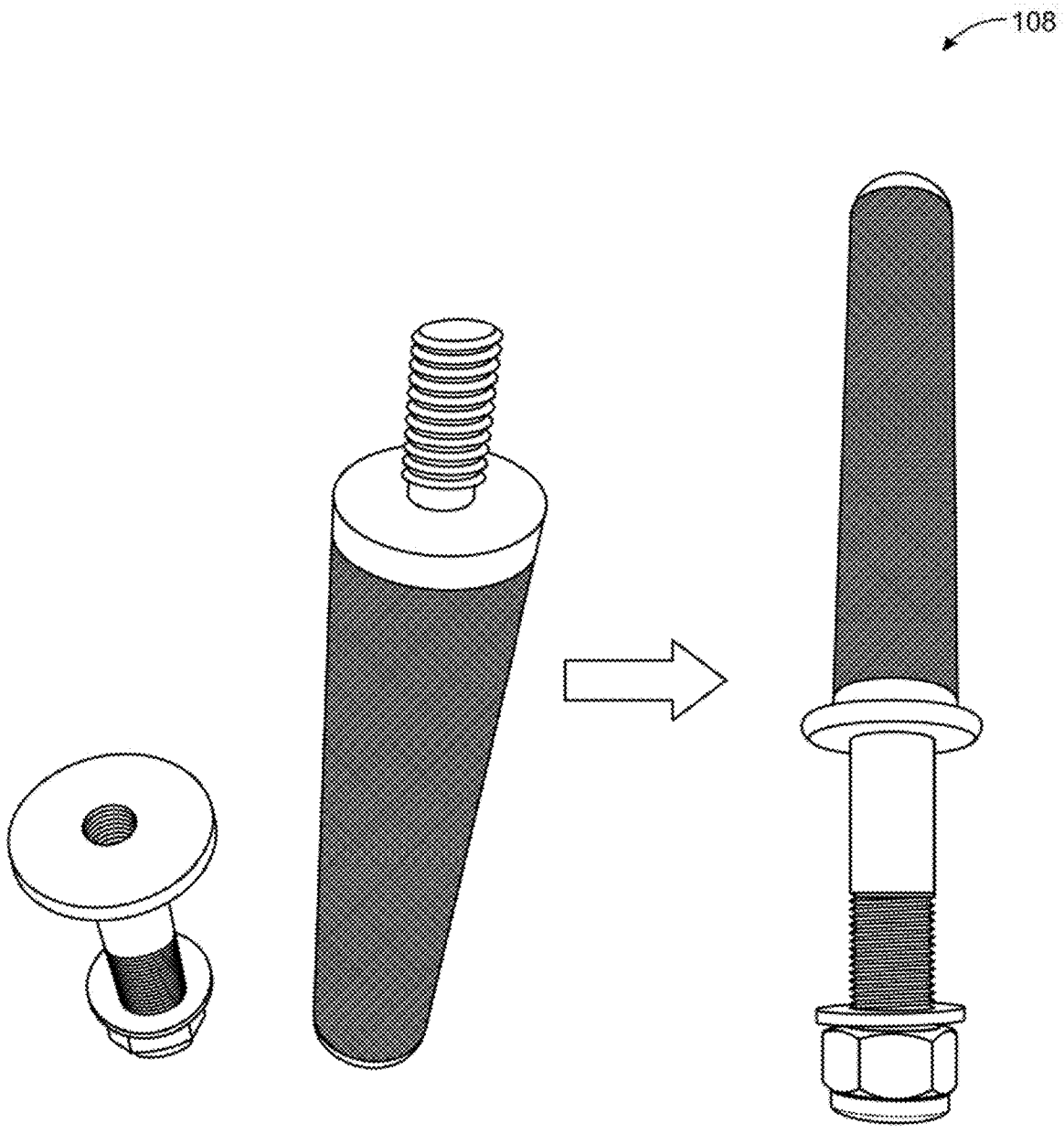

The following detailed description is made with reference to the technology disclosed. Preferred implementations are described to illustrate the technology disclosed, not to limit its scope, which is defined by the claims. Those of ordinary skill in the art will recognize a variety of equivalent variations on the description.

Various terms as used herein are shown below. To the extent a term used in a claim is not defined below, it should be given the broadest definition persons in the pertinent art have given that term as reflected in printed publications and issued patents at the time of filing.

Although the present disclosure has been described with the purpose of implementing an improved peg system of a table top for armwrestling. It should be appreciated that the same has been done merely to illustrate the invention in an exemplary manner and any other purpose or function for which the explained structure or configuration can be used, is covered within the scope of the present disclosure.

Peg systems (108) are positioned at the front edge of the table. Hand pegs provide a stable hold for the non-wrestling hand of the competitors. Pegs can vary in design, but they are typically ergonomic and allow the wrestler to exert force while maintaining balance and stability.

The hand pegs on an arm-wrestling table serve several important purposes, contributing significantly to the dynamics and fairness of the match. Following reasons as to why the hand peg is important:

Stability and Control: The hand peg provides a stable point of contact for the non-wrestling hand of each competitor. By gripping the peg firmly, wrestlers can exert force and maintain control over their body position during the match. This stability is crucial for maintaining balance and applying maximum force against the opponent's hand and arm.

Leverage: The positioning of the hand peg relative to the elbow pad allows wrestlers to leverage their body weight and strength more effectively. By anchoring their non-wrestling hand on the peg, wrestlers can generate torque and transfer power from their upper body to their arm, enhancing their ability to push or pull against the opponent.

Counterbalance: During an arm-wrestling match, competitors exert considerable force, which can lead to shifts in body weight and balance. The hand peg serves as a counterbalance, helping wrestlers to stabilize their upper body and prevent tipping or falling off the table. This is especially important in intense matches where both competitors are pushing their limits.

Preventing Fouls: In official arm-wrestling competitions, there are rules governing hand placement and movement. The hand peg provides a designated area for the non-wrestling hand, helping to prevent fouls such as lifting or sliding the hand off the table during the match. By maintaining contact with the hand peg, wrestlers can ensure that they adhere to these rules and avoid fouls.

Fairness: Ensuring that both competitors have access to a stable hand peg promotes fairness in the match. By providing a standardized point of contact for the non-wrestling hand, the hand peg helps to create a level playing field where wrestlers can focus on using their strength and technique to overcome their opponent, rather than being hindered by differences in table setup or equipment.

Overall, the hand peg plays a critical role in arm wrestling, providing stability, leverage, and fairness to competitors as they vie for victory on the arm-wrestling table.

FIGS. 2A-2E illustrates a peg system and its components, in accordance with an embodiment of the present invention.

An embodiment of the present disclosure provides an armwrestling table having a table top 102. The table top 102 has at least a first layer 302 and a second layer 304. The armwrestling table includes peg systems 108 to provide a hold for a non-wrestling hand of at least one competitor. The peg system 108 includes a peg 108-1 and has a handle 202-1 and a threaded part 202-2. The peg 108-1 operates as the handle.

The peg system 108 further includes a peg base 108-2 having a bore 204 provided with one or more inner threads adapted to receive the threaded part 202-2 of the peg 108-1 to hold the handle at least perpendicular to the table top 102. The peg base also has a flat head 205 and an elongated body 206.

The elongated body 206 of the peg base 108-2 comprises a plurality of outer threads 206-1 to accommodate at least one fastener 206-2 thereon such that the flat head 205 rests on a top surface of the table top 102 and the elongated body 206 passes through the first layer 302 and the second layer 304 so as to rigidly hold the first layer 302 and the second layer 304 of the table top intact to provide strength and rigidity to the table top when the at least one fastener 206-2 is fastened to thereby stabilize the armwrestling table when the at least one competitor exerts force on the handle while maintaining balance and stability.

In this embodiment, the first layer 302 is a wood top. In an exemplary embodiment, the wood top holds any or a combination of a leather and a foam.

In this embodiment, the second layer 304 is a steel frame.

Figure 3A:
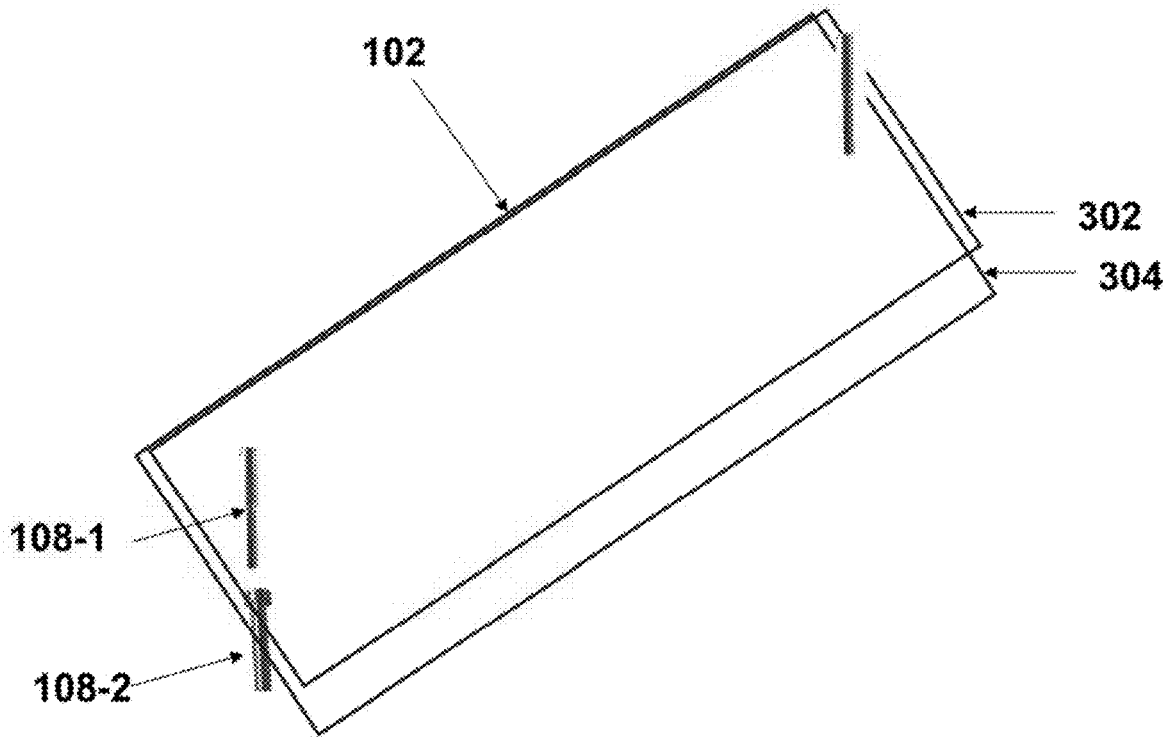
FIGS. 3A-3B illustrates a view showing a peg system installed at the table top, in accordance with an embodiment of the present invention.
Figure 3B:
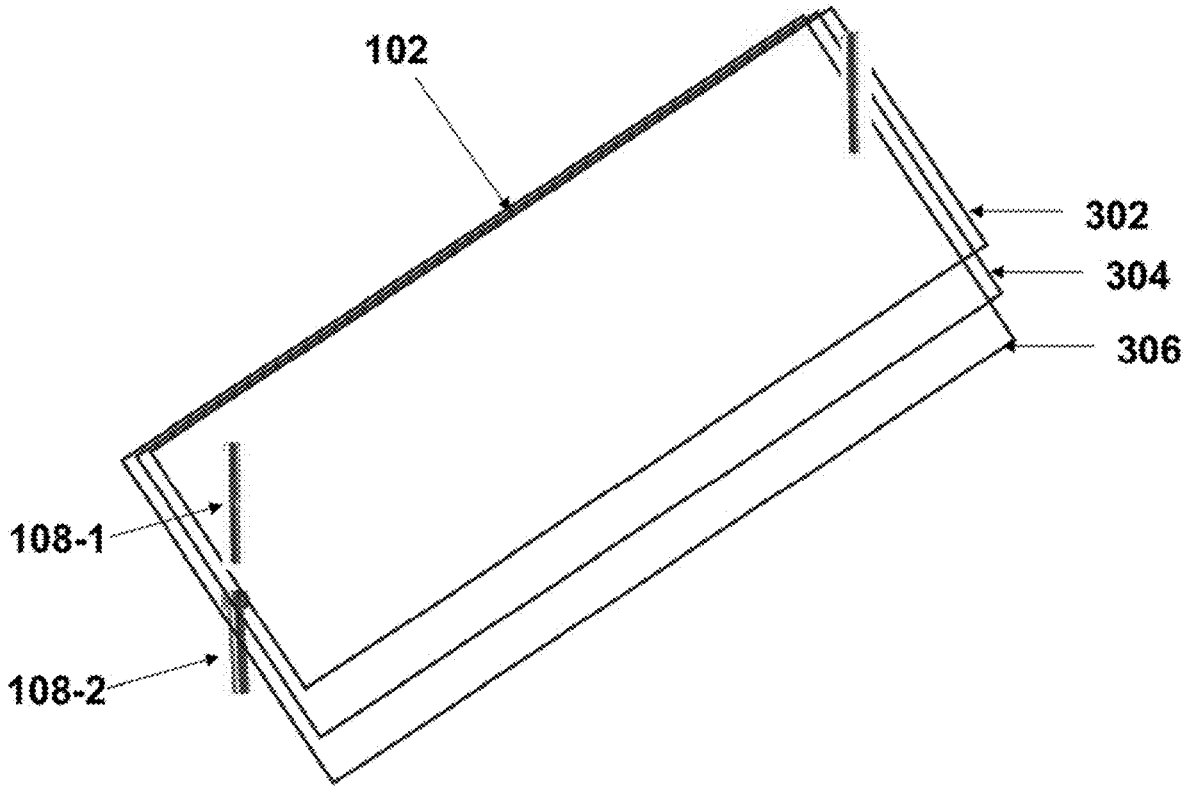

In this embodiment, the table top 102 having a third layer 306 of a foam, and wherein the elongated body 206 passes through the first layer 302, the second layer 304, and the third layer 306. FIG. 3B illustrates a view showing a hand peg installed at the table top, in accordance with an embodiment of the present invention.

In this embodiment, the threaded part 202-2 comprises a plurality of ridges that are adapted to fit in the one or more inner threads of the peg base 108-2.

In this embodiment, the threaded part of the peg comprises a plurality of ridges that are adapted to be inserted in the peg base.

In this embodiment, the peg is made of a steel or an iron material. In an embodiment, the peg and the peg base are made of a steel or an iron material.

In this embodiment, the at least one fastener is a nut.

In another embodiment, an armwrestling table is disclosed. The armwrestling table includes a table top 102, and a peg system 108 to provide a hold for a non-wrestling hand of at least one competitor. The peg system 108 includes a peg 108-1 having a handle 202-1 and a threaded part 202-2. The peg operates as the handle.

The peg system 108 also includes a peg base 108-2 having a flat head 205, an elongated body 206, and a bore 204 provided with one or more inner threads passing length wise through the flat head 205 and the elongated body 206. The bore 204 is adapted to receive the threaded part 202-2 of the peg 108-1 to hold the handle at least perpendicular to the table top 102.

The elongated body 206 of the peg base 108-2 comprises a plurality of outer threads 206-1 to accommodate at least one fastener 206-2 thereon, such that the flat head 205 rests on a top surface of the table top 102 and the elongated body 206 passes through the first layer 302 and the second layer 304.

In this embodiment, the first layer 302 is a wood top. In an exemplary embodiment, the wood top holds any or a combination of a leather and a foam.

In this embodiment, the second layer 304 is a steel frame.

In this embodiment, the table top 102 having a third layer 306 of a leathered foam, and wherein the elongated body 206 passes through the first layer 302, the second layer 304, and the third layer 306. FIG. 3B illustrates a view showing a hand peg installed at the table top, in accordance with an embodiment of the present invention.

In this embodiment, the threaded part 202-2 comprises a plurality of ridges that are adapted to fit in the one or more inner threads of the peg base 108-2.

In this embodiment, the threaded part of the peg comprises a plurality of ridges that are adapted to be inserted in the peg base.

In this embodiment, the peg is made of a steel or an iron material. In an embodiment, the peg and the peg base are made of a steel or an iron material.

In this embodiment, the at least one fastener is a nut.

To summarize the present invention, the peg system of the present invention is divided into two parts. A first part is a peg which is the handle that is there for the arm-wrestler to hold while armwrestling with his/her other arm. The peg has a male thread. A second part is a peg base which has a head that rests on the surface of the table and has a vertical body. The body has either full or a partial outer male thread that passes through the leather, foam, wooden top and steel frame. The male portion (thread) is responsible of holding leather, foam, wooden top and steel frame only when fastened or locked (the strength and rigidity is attained only when fastened or locked). The female thread passes through the head as well as the body of the peg base and creates a space to receive the male portion of the peg.

In contrast to the convention pegs used in/on a table top for armwrestling table, the peg system, specifically the peg base holds the table wooden top including its leather and foam as well as the steel frame together, and also, allows the peg to sit in it. The peg base provides strength and rigidity to the table top when the at least one fastener is fastened to thereby stabilize the armwrestling table when the at least one competitor exerts force on the handle while maintaining balance and stability.

From the foregoing it will be seen that an arm-wrestling exercise device has been provided which is adjustable for persons of different physical size and which simulates actual arm wrestling both in visual appearance and in tensioned reaction.

While some embodiments of the present disclosure have been illustrated and described, those are completely exemplary in nature. The disclosure is not limited to the embodiments as elaborated herein only and it would be apparent to those skilled in the art that numerous modifications besides those already described are possible without departing from the inventive concepts herein. All such modifications, changes, variations, substitutions, and equivalents are completely within the scope of the present disclosure. The inventive subject matter, therefore, is not to be restricted except in the protection scope of the appended claims.

What is claimed is:

1. An armwrestling table having a table top, the armwrestling table comprising:
   - the table top having at least a first layer and a second layer;
   - a peg system configured to provide a hold for a non-wrestling hand of at least one competitor, the peg system comprises:
     - a peg having a handle and a threaded part; and
     - a peg base having a bore provided with one or more inner threads adapted to receive the threaded part of the peg to hold the hand peg at least perpendicular to the table top;
   - wherein the peg base has a flat head and an elongated body, and
   - wherein the elongated body of the peg base comprises a plurality of outer threads to accommodate at least one fastener thereon, such that the flat head rests on a surface of the table top and the elongated body passes through the first layer and the second layer so as to rigidly hold the first layer and the second layer of the table top intact to provide strength and rigidity to the table top when the at least one fastener is fastened to thereby stabilize the armwrestling table when the at least one competitor exerts force on the handle while maintaining balance and stability.

2. The armwrestling table of claim 1, wherein the first layer is a wood top.

3. The armwrestling table of claim 2, wherein the wood top holds any or a combination of a leather and a foam.

4. The armwrestling table of claim 1, wherein the second layer is a steel frame.

5. The armwrestling table of claim 1, wherein the table top has a third layer of a leathered foam, and wherein the elongated body passes through the first layer, the second layer, and the third layer.

6. The armwrestling table of claim 1, wherein the threaded part comprises a plurality of ridges that are adapted to fit in the one or more inner threads of the peg base.

7. The armwrestling table of claim 1, wherein the threaded part comprises a plurality of ridges that are adapted to be inserted in the peg base.

8. The armwrestling table of claim 1, wherein the peg is made of a steel or an iron material.

9. The armwrestling table of claim 1, wherein the at least one fastener is a nut.

10. An armwrestling table comprising:

a table top; and a hand peg configured to provide a hold for a non-wrestling hand of at least one competitor, the hand peg comprises:

a peg having a handle and a threaded part; and a peg base having a flat head, an elongated body, and a bore provided with one or more inner threads passing length wise through the flat head to the elongated body, the bore is adapted to receive the threaded part of the peg to hold the handle at least perpendicular to the table top;

wherein the elongated body of the peg base comprises a plurality of outer threads to accommodate at least one fastener thereon, such that the flat head rests on a surface of the table top and the elongated body passes through the first layer and the second layer.

11. The armwrestling table of claim 10, wherein the table top comprises a first layer, a second layer and a third layer.

12. The armwrestling table of claim 11, wherein:

the first layer is a wood top;

the second layer is a steel frame; and the third layer is of a foam or a leather; and wherein the peg base passes through the first layer, the second layer, and the third layer.

13. The armwrestling table of claim 10, wherein the threaded part comprises a plurality of ridges that are adapted to fit in the one or more inner threads of the peg base.

14. The armwrestling table of claim 10, wherein the threaded part comprises a plurality of ridges that are adapted to be inserted in the peg base.

15. The armwrestling table of claim 10, wherein the hand peg is made of a steel or an iron material.

* * * * *